US007305855B2

(12) United States Patent
Bruske et al.

(10) Patent No.: US 7,305,855 B2
(45) Date of Patent: Dec. 11, 2007

(54) MACHINE KNITTING NEEDLE

(75) Inventors: Johannes Bruske, Albstadt (DE); Holger Cebulla, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/524,432

(22) Filed: Sep. 21, 2006

(65) Prior Publication Data

US 2007/0084250 A1 Apr. 19, 2007

(30) Foreign Application Priority Data

Sep. 22, 2005 (EP) ..... 05020629

(51) Int. Cl.
*D04B 35/04* (2006.01)

(52) U.S. Cl. ..... 66/121; 66/123

(58) Field of Classification Search ..... 66/116, 66/121, 122, 123

See application file for complete search history.

(56) References Cited

U.S. PATENT DOCUMENTS

| | | | | |
|---|---|---|---|---|
| 757,378 | A * | 4/1904 | Woodward | 66/121 |
| 1,022,238 | A * | 4/1912 | Heaton | 66/121 |
| 1,032,613 | A | 7/1912 | Korndoerfer, Jr. | |
| 1,168,039 | A * | 1/1916 | Swinglehurst | 66/121 |
| 1,629,275 | A | 5/1927 | Kennedy | |
| 1,997,530 | A * | 4/1935 | Mills | 66/121 |
| 2,292,940 | A | 8/1942 | Holmes et al. | |
| 3,063,274 | A * | 11/1962 | Kohl | 66/203 |
| 4,512,164 | A | 4/1985 | Fukuhara et al. | |
| 5,609,045 | A * | 3/1997 | Schmoll et al. | 66/121 |

FOREIGN PATENT DOCUMENTS

| | | |
|---|---|---|
| DE | 27 14 607 C3 | 10/1978 |
| GB | 301349 | 11/1928 |
| GB | 380554 | 9/1932 |

* cited by examiner

*Primary Examiner*—Danny Worrell
(74) *Attorney, Agent, or Firm*—Venable LLP; Ralph P. Albrecht; Ryan M. Flandro

(57) ABSTRACT

The machine knitting needle of the invention, beginning at its hook (3), between the hook (3) and its latch bearing (9), has a convex or at least not concave shank contour, which defines the inner hook contour and on one end (18) adjoins the concave inner hook contour directly. It is attained as a result that the elevation angle which a yarn (23), located in the hook (3), must overcome if it is to slide on the shank does not increase at any point along the inner contour (17). Preferably, it even decreases steadily. It thus has its maximum value inside a space which is defined on the one hand by the inner hook contour (15) and on the other by a plumb line (L) or (L1) which is dropped, from the hook tip (12) or its tapering portion (11), onto the needle back (16), or if the needle back is not oriented parallel to the direction of motion of the machine knitting needle, onto the arrow that defines the direction of motion. The convex or at least not concave shank contour (17) merges continuously with the likewise convex contour of the needle cheek (7).

12 Claims, 6 Drawing Sheets

MACHINE KNITTING NEEDLE

Figure 1:
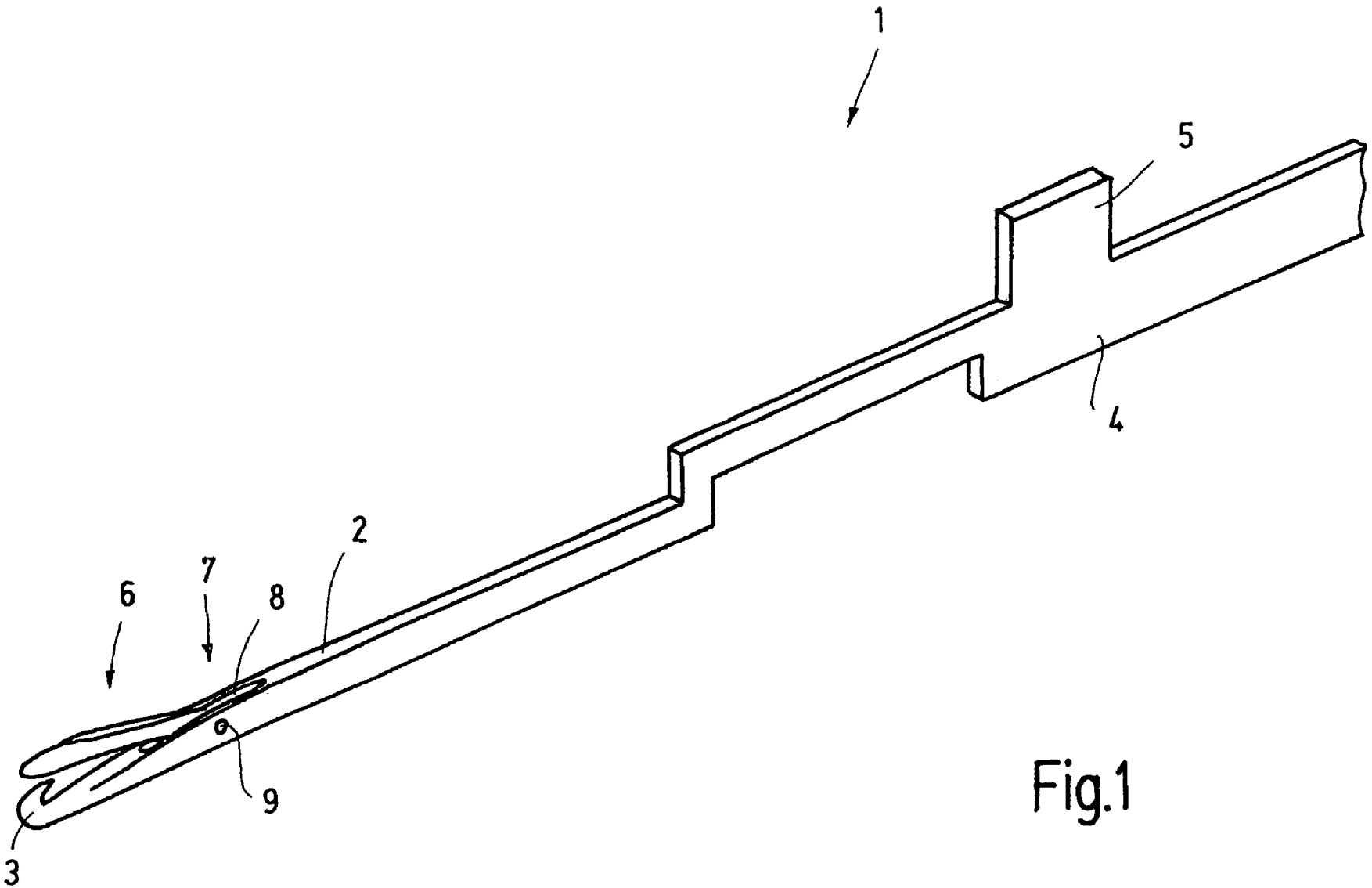

The invention relates to a machine knitting needle, which is intended in particular for high-speed circular knitting machines but in principle is also suitable for all other kinds of knitting machines or even warp knitting machines.

In use, machine knitting needles of the kind known for instance from U.S. Pat. No. 1,629,275, are moved back and forth longitudinally at an increasingly high knitting speed. Loops caught by the hook of the needle slide on the shank in the process, moving a latch provided on the machine knitting needle to the back position, for instance. This motion is reinforced by the intrinsic inertia of the latch. The latch therefore swings back and forth between the closing position and the back position, striking the hook and the shank in alternation. With increasing knitting speed, the striking of the latch, especially in the back position, is a problem with regard to the durability of a machine knitting needle. It must be assured that impermissible wear of the machine knitting needle and especially breakage of the latch or needle body will not occur over the service life of the machine knitting needle. To aid in accomplishing this, the attempt has already been made to damp the impact of the latch when it pivots into the back position and strikes the shank. To that end, German Patent DE 27 14 607 C3 discloses a special design of the needle slot, which is defined by more or less elastically embodied shank cheeks. The elastic shank cheeks elastically intercept the latch and damp the impact.

The goal is to use latch needles at higher and higher operating speeds.

It is the object of the invention to improve the machine knitting needles in this sense.

The needle according to the invention has a shank which has a convex shank contour between the hook and the needle cheek. With this provision, the load on the latch and the shank is reduced when the latch comes to a stop in the back position and meets the shank. In previous machine knitting needles, the shank contour between the hook and the needle cheek, the latter comprising the throat and the cheek elevation, is essentially concave. The throat then forms the transition between the hook or head and the cheek elevation. The cheek elevation is the connection between the needle cheek, or in other words the curved elevation in which the latch is secured, and the throat of the machine knitting needle. Thus the yarn, when it is supposed to slide from the hook interior over the throat and the cheek elevation onto the needle cheek, rises along the shank contour. The angle of friction of the yarn increases steadily during its motion in the direction of the needle cheek. At the transition from the shank contour, that is, from the cheek elevation, to the needle cheek, the angle of friction is relatively large. The yarn tension is therefore high. Because of the rapid reduction in the elevation at the transition point, the angle of friction decreases virtually abruptly. The high yarn tension that still prevails and the now absent friction angle allow the yam to spring across the needle cheek, and the impetus resulting from the yam tension is passed onward to the latch. The latch therefore strikes the shank at high speed in the back position. In many cases, this proves to be the cause of latch and needle breakage. With the design according to the invention, precisely this is avoided. The nonconcave shank contour causes the loop that is seated in the hook interior to begin rising sooner when it slides in the direction of the latch bearing. When it meets the latch, it has already accomplished a majority of the rise and can now slide at relatively uniform speed over the needle cheek with a gradually decreasing angle of friction. Because of the absence of the abrupt loop motion, the latch is accelerated less markedly and consequently meets the shank at reduced speed in the latch back position. This effect permits a substantial increase in the operating speed of the machine knitting needle.

Preferably, the nonconcave shank contour already begins inside the hook, specifically once again preferably directly adjoining the concave groove region of the hook. The transition point is then preferably located at a point which is at least as far away from the bearing point as the tapering portion of the hook tip is.

Preferably, the radii of curvature of the inner hook contour and of the shank contour are each essentially constant. The center of curvature of the inner hook contour is located in the hook interior. The center of curvature for the nonconcave, preferably convex shank contour is located below the underside of the needle or below the needle back.

In principle, the nonconcave shank contour forms a rounded ramp, which assures that the elevation angle, opposite the loop as the loop moves from the hook interior onward over the needle cheek, decreases continuously even before the loop meets the latch.

In this connection, it is furthermore advantageous if the latch is embodied as concave on its side oriented toward the hook interior. This not only reduces the mass of the latch but also allows the loop to meet the latch relatively late, or in other words only at relatively small elevation angles.

Further details of advantageous embodiments of the invention are the subject of the drawings, description or claims.

In the drawings, exemplary embodiments of the invention are shown.

Figure 2:
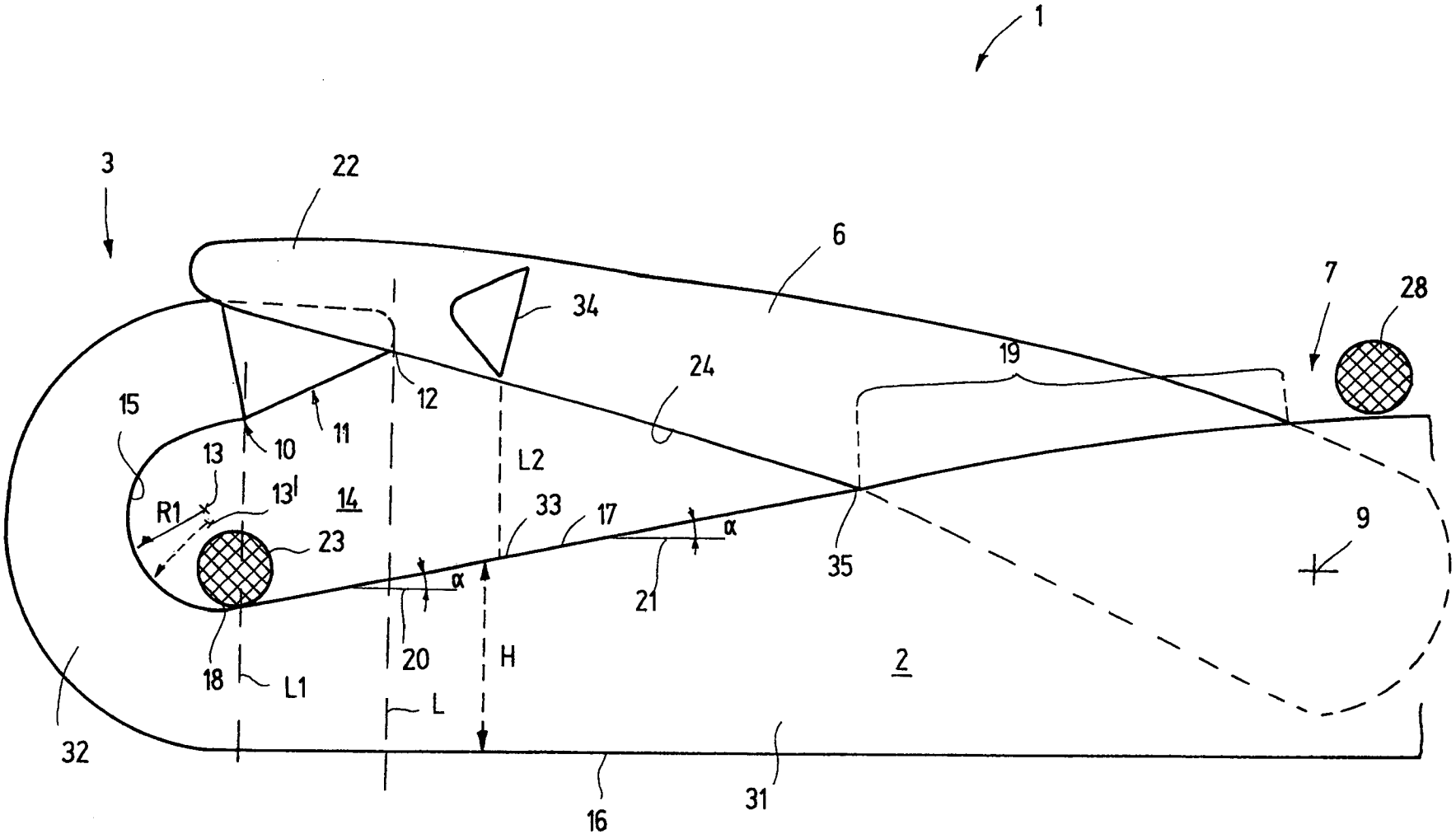
Figure 3:
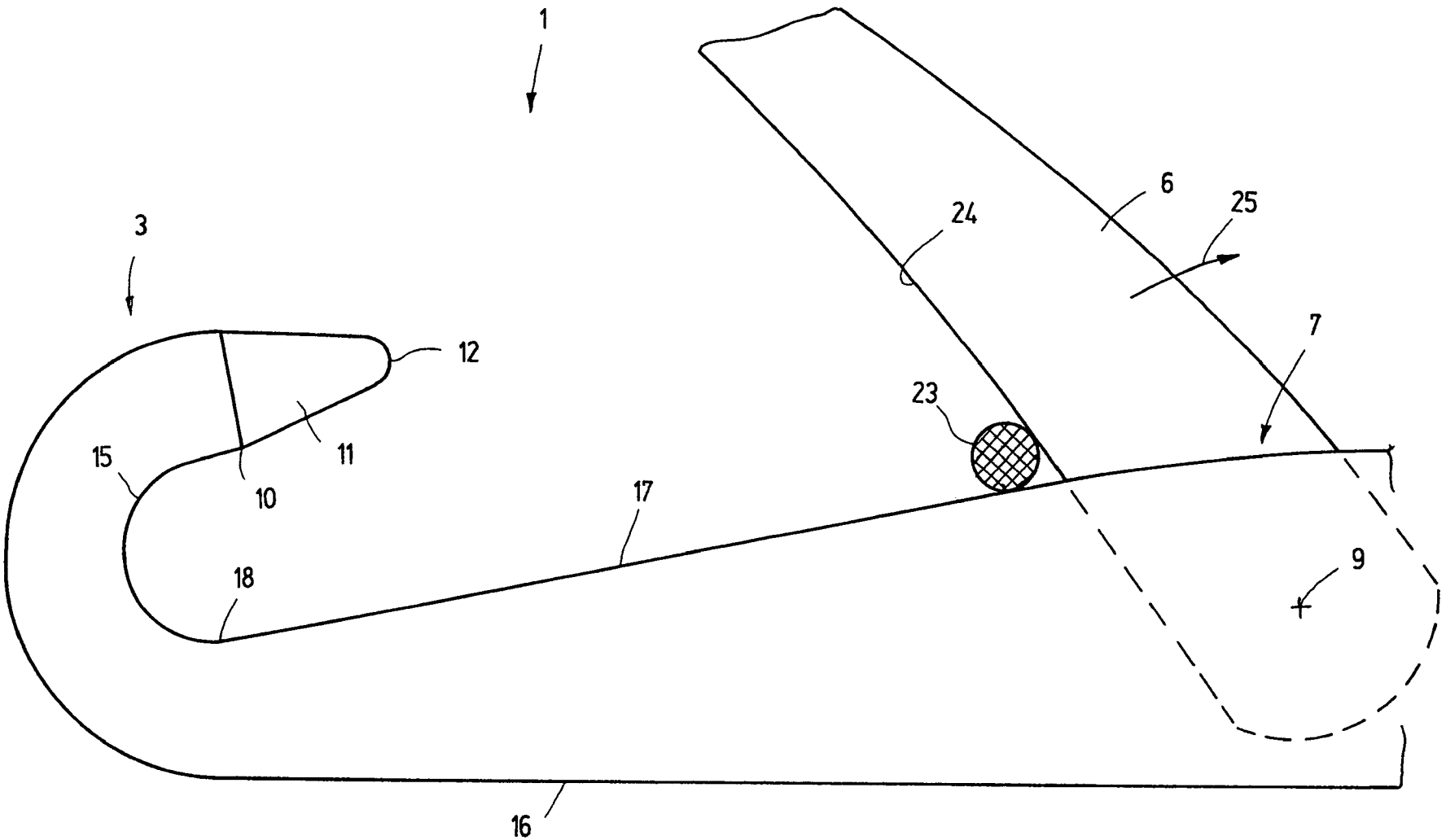
Figure 4:
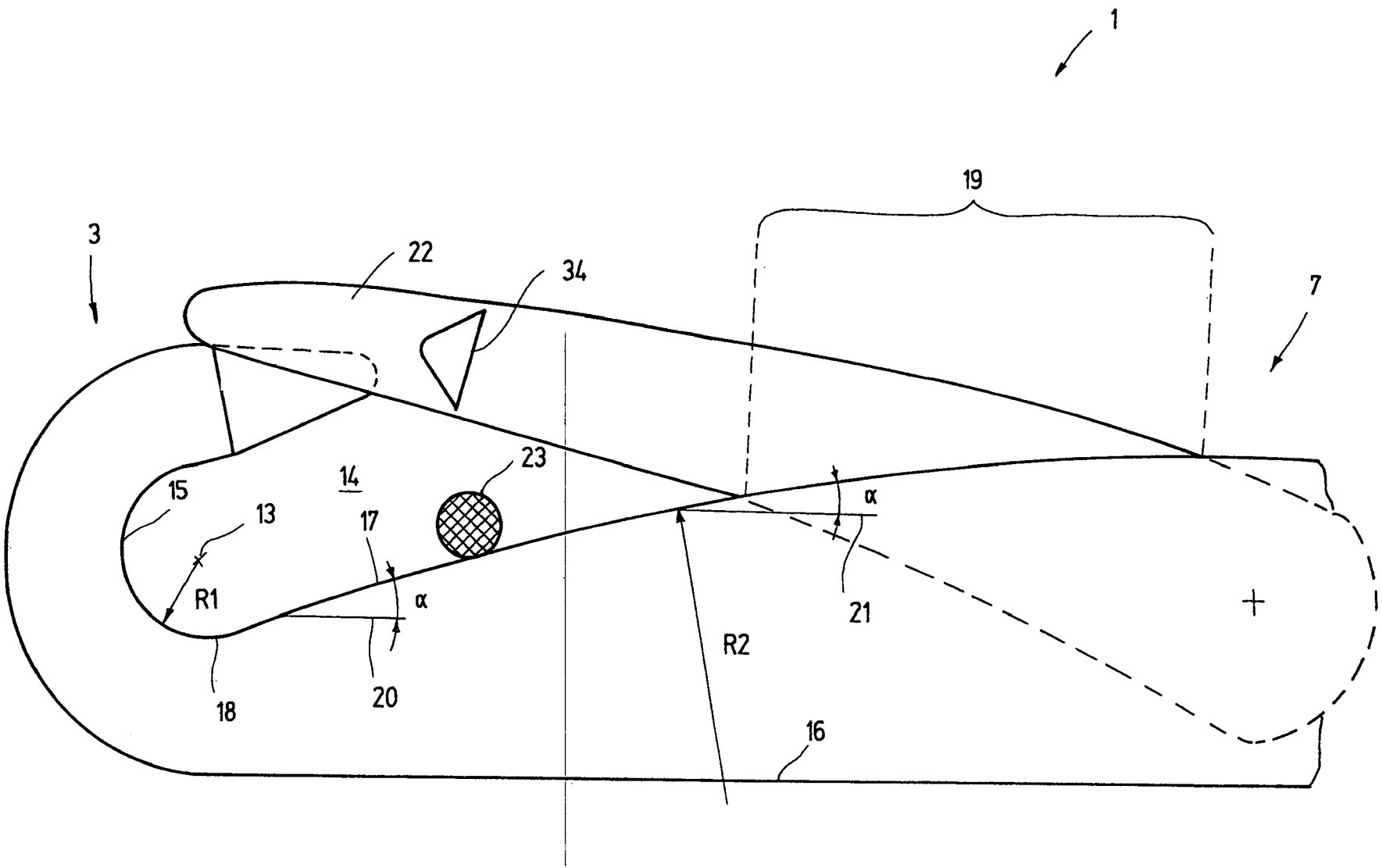
Figure 5:
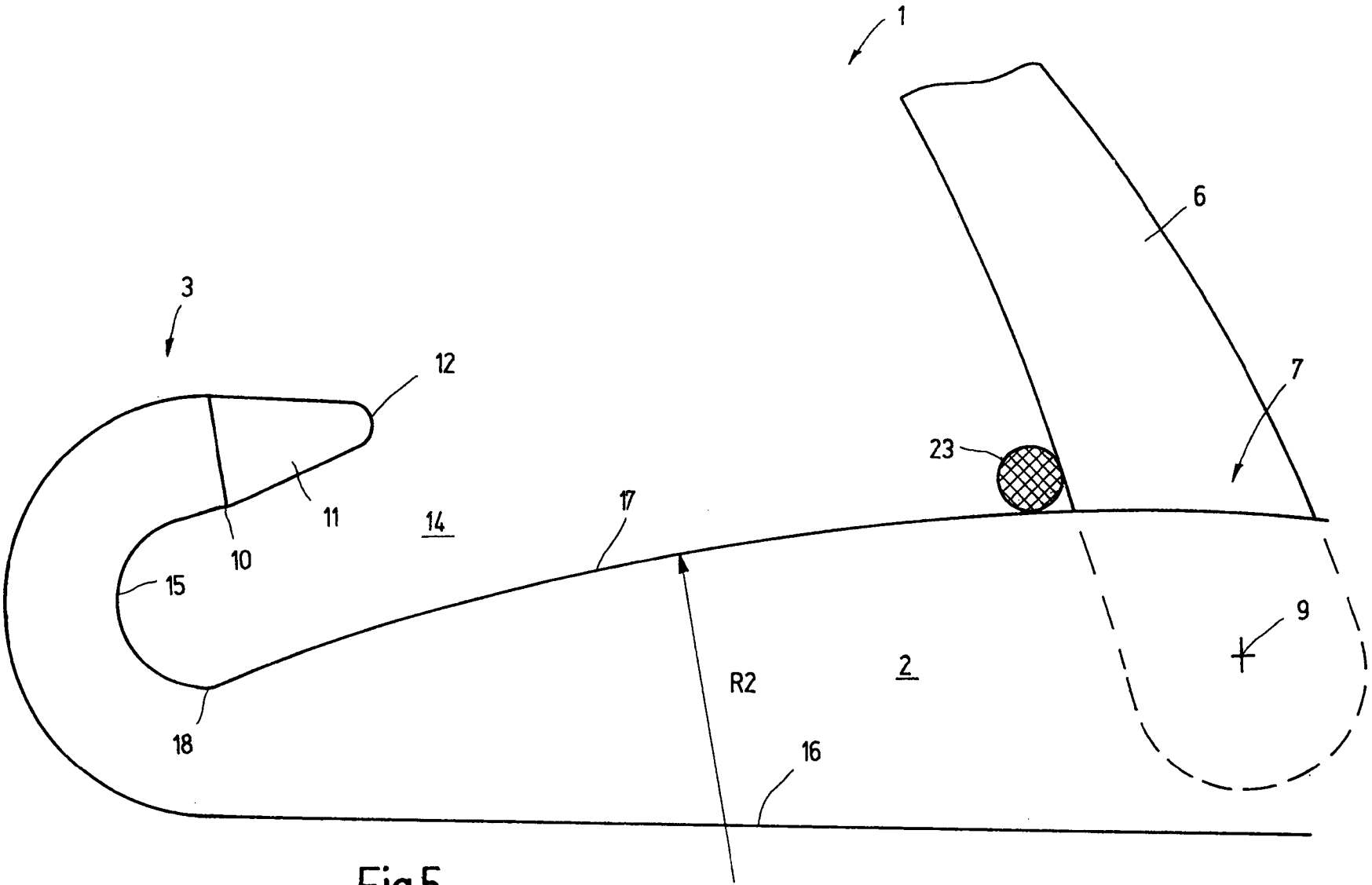
Figure 6:
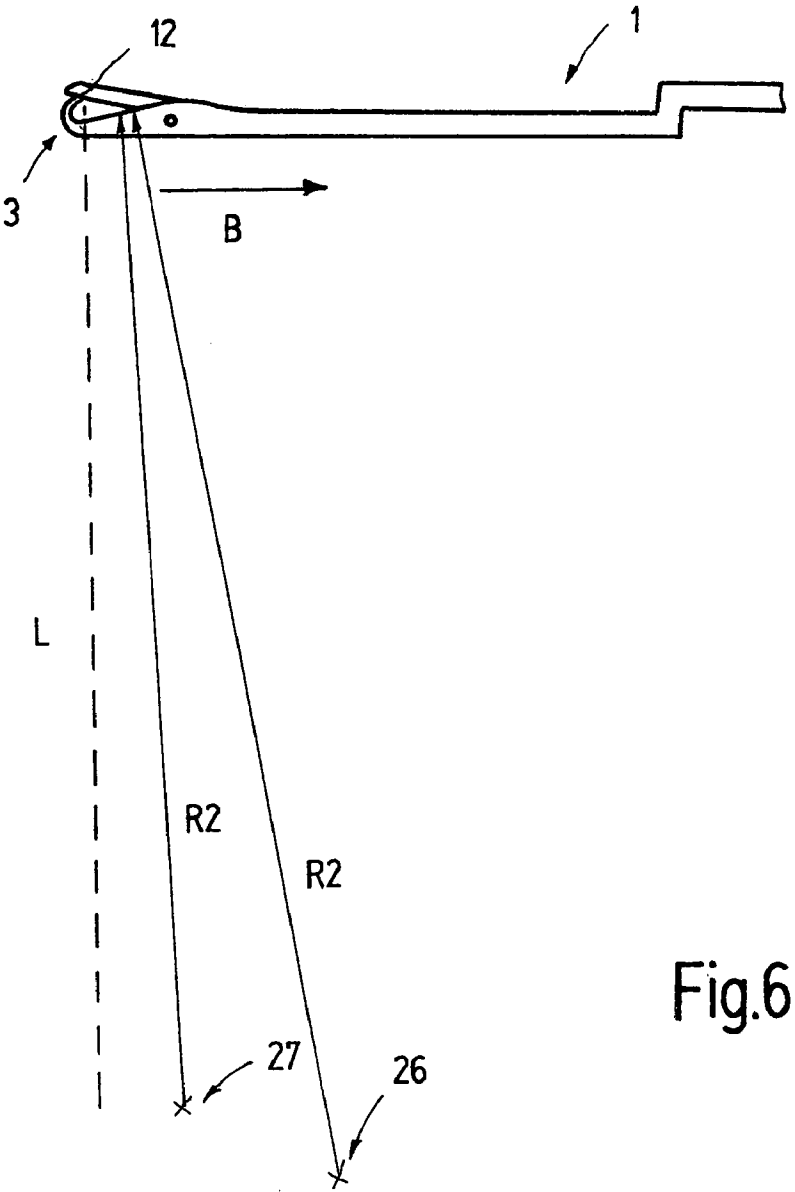

FIG. 1, in a basic perspective view, shows the machine knitting needle of the invention;

FIG. 2, in a fragmentary side view on a different scale, shows the needle of FIG. 1 with the latch in the closing position;

FIG. 3 shows the needle of FIG. 2 with the latch during the opening event;

FIG. 4, in a fragmentary side view, shows a modified embodiment of the machine knitting needle of the invention with the latch in the closing position;

FIG. 5 shows the machine knitting needle of FIG. 4 with the latch during the opening event; and FIG. 6 is a schematic side view of the latch needle of FIG. 4.

In FIG. 1, a machine knitting needle 1 is shown which has an elongated shank 2 on the end of which a hook 3 is embodied. The shank merges, for instance in undulating form, with a needle body 4 having a suitable means for driving the machine knitting needle 1, for instance in the form of a butt 5.

Associated with the hook 3 is a latch 6, which at a point of the shank 2 that is convex at the top and is called the needle cheek 7 protrudes out of a sawslot 8, in which the latch is pivotably supported by a latch bearing 9. The latch bearing 9, in FIG. 1 as in the other drawings, is indicated merely schematically.

The hook 3, as FIG. 2 shows, preferably has an approximately uniform, for instance round, oval or circular cross section, which merges at a point 10 with a tapering portion 11 that has approximately the outer shape of a truncated cone and is rounded somewhat on its end that forms a hook tip 12. The hook 3 essentially forms a 180° arc that defines a concave inner contour. It follows a curvature having the radius R1, about a center of curvature 13 that is located in the hook interior 14. The radius R1 is preferably constant.

However, it may also vary somewhat along the inner hook contour 15. Various portions of the inner hook contour 15 may also have different centers of curvature 13, 13'.

Adjoining the hook 3, the shank 2 of the machine knitting needle merges with a substantially straight needle back 16; the height H of the shank 2, measured plumb to the needle back, increases toward the latch bearing 9. The shank 2 defines the hook interior 14 between the hook 3 and the latch bearing 9, with a shank contour 17 that comprises a throat 32 and a cheek elevation 31. The throat 32 begins at the point 10 and ends at the plumb line L2 of the point 33 at which the cheek elevation 31 begins. The point 33 is found by dropping the plumb line L2 from the end 34 of the spoon 22 (FIG. 2) onto the needle back 16. The point 34 represents the transition between the end of the spoon 22 and the shank of the latch 6. The elevation of the shank contour 17, beginning at the end 18 of the inner hook contour, does not increase; preferably, the elevation decreases. In the embodiment of FIG. 2, the elevation is nearly constant, beginning at the end 18, or in other words the transition region from the inner hook contour 15 to the shank contour, into the portion 19 of the cheek 7. This portion 19 is covered in the closing position by the latch 6. The cheek elevation 31 ends at the point 35, at which the portion 19 begins. The elevation is defined as the angle $\alpha$ between the particular point being observed along the shank contour 17 and a line 20, 21 that is parallel to the needle back 16. In the embodiment of FIG. 2, the shank contour 17, beginning at the end 18 and extending into the region 19, follows above a straight line with little curvature. From the end 18 of the shank elevation 17 to the point 33, the angle $\alpha$ decreases slightly. The region 18 is located inside the hook 3, or in other words at least inside a region which is defined on the one hand in FIG. 2 on the left by the inner hook contour 15 and on the right by the plumb line L dropped from the tip 12 onto the needle back 16. Preferably, the end 18 is located in a region that is defined on the left by the contour 15 and on the right by a plumb line L1 that is dropped from the point 10 onto the needle back 16.

In the exemplary embodiment of FIG. 3, The End 18 of the shank contour 17 is located closer to the needle back 16 than the latch bearing 9 is. Although the elevation decreases constantly from the point 18, the point 35 is located above the latch bearing 9. This means that the spacing between the needle back 16 and the end, located at the point 35, of the shank elevation 17 is greater than the spacing between the center point of the latch bearing 9 and the needle back 16.

In another exemplary embodiment (not shown), it is possible for the spacing of the end 18 of the shank contour 17 from the needle back 16 to be less than the spacing between the needle back 16 and the highest point of the needle cheek 7. This means that in the vertical direction, perpendicular to the longitudinal direction of the needle, the point 18 is located between or at the center point of the latch bearing and the highest point of the needle cheek 7.

The machine knitting needle 1 described thus far functions as follows:

During operation, the machine knitting needle 1 is moved rapidly back and forth in the longitudinal direction of the shank. During the needle return (motion toward the right in FIG. 2), the latch 6, driven by the yarn 28 that moves on the shank back over the latch shank in the direction of the hook 3, moves toward the hook 3 and with its latch spoon 22 closes the hook interior 14. The latch 6 is then in the closing position.

When the needle is driven outward, that is, upon a rapid motion toward the left in FIG. 2, a yarn 23 located in the hook interior moves, beginning at the position shown in FIG. 2, approximately in the vicinity of the end 18 on the shank contour 17, in the direction of the latch 6. The latch 6, under the influence of its own inertia and/or the tension of the yam 23 resting on its inner side 24, moves in the direction of its back position. In the process, it pivots about an axis of rotation defined by the latch bearing 9. The pivoting motion is represented in FIG. 3 by an arrow 25. Because of the uniform elevation of the shank contour 17, beginning at the hook 3 and extending as far as the needle cheek 7, the yarn is prevented from staying or being delayed in the region of the end toward the hook of the needle cheek 7. A relatively constant sliding speed is thus imparted to the yarn 23. Speed spikes are intentionally avoided. This minimizes the motion impetus, and thus the possibility of transmitting the motion impetus from the yarn 23 to the latch 6. The pivoting speed of the latch 6 thus remains relatively slight. If the latch in the back position meets the shank, the speed with which it meets it is in a relatively moderate range there. Wear effects and bouncing of the latch are thus diminished. Moreover, an improvement in the stitch pattern and hence in the quality of the goods produced is obtained because the yarn sliding speed is made uniform. Moreover, yarn damage and an associated development of dust in the knitting process can be reduced.

The machine knitting needle 1 is as a rule moved back and forth longitudinally by means of a knitting cam. The transmission of force is effected via the butt 5 of the needle 1; the butt follows the substantially sinusoidal knitting curve of the cam. The machine knitting needle 1 reaches its greatest speed between the two turning points, while in the region of the turning points themselves, the needle speed is instead low. The nonconcave shank contour and in particular the convex shank contour prove to be especially advantageous, taking dynamic conditions into account: When the machine knitting needle 1 is driven outward, the yarn 23 overcomes the initially high elevation of the shank contour 17 at a comparatively low needle speed. When the machine knitting needle 1 nearly reaches its maximum speed, the loop is located in a region of the cheek elevation 31 that has little elevation. Overall, the motion of the loop is accordingly made considerably more uniform. Taking this finding into account, the end 18 of the shank contour 17 can be shifted in the direction of the latch bearing 9 and can thus even be located outside the hook interior 14. For instance, the end 18 can be located between the plumb line L and the point 33.

FIGS. 4 and 5 illustrate a modified embodiment, which is still further improved in terms of the aforementioned characteristics, of the machine knitting needle 1 of the kind shown in principle in FIG. 1. The above description of the machine knitting needle 1 applies accordingly. Unlike the above description, the convex shank contour 17 is more markedly curved. For instance, it follows a radius R2, whose center of curvature in FIGS. 4 and 5 is located below the needle back 16, or in other words outside the hook interior 14. The radius R2 may either be constant or may vary from the end 18 to the needle cheek 7, or in other words at least in the region 19. It is equally possible for various portions of the shank contour 17 to be curved with different centers of curvature 26, 27. Regardless of this, as FIG. 4 shows, the effect is attained that the elevation angle a of the inner contour 17, measured relative to a respective line 20, 21 parallel to the needle back 16, decreases from the hook 3 to the needle cheek 7. In FIG. 4, the elevation angle a is greater on the left than on the right. This is attained in that the center of curvature 26, 27, about which the shank contour 17 curves with the radius R2, as FIG. 6 shows, is located downstream of the plumb line L in terms of the direction of motion of the machine knitting needle 1. The direction of motion B of the latch needle 1 is indicated in FIG. 6 by an arrow. The plumb line L meets the direction of motion B at a right angle and extends through the tip 12 of the hook 3. While the hook 3 is located on one side of this plumb line L3, the center of curvature 26, 27 is located on the other side of the plumb line. In all the embodiments described above, the needle back 16 is parallel to the direction of motion B. It may also be inclined at an acute angle to the direction of motion B. In that case, the plumb lines L and L1 are referred to the direction of motion B. Otherwise, the above description applies accordingly.

As a result of the decreasing elevation of the shank contour 17 toward the latch 6, the friction of the yarn 23, as it slides along the inner contour 17, decreases further more and more toward the needle cheek 7. As a result, the relative sliding speed between the machine knitting needle 1 and the yarn 23 is made uniform, which greatly reduces the maximum yarn sliding speed. This is accomplished in particular as a result of the steady decrease in the elevation angle $\alpha$ from the end 18 toward the latch 6 and the latch bearing 9. The impetus of the yarn 23, transmitted to the latch 6, is minimized, and as a result the maximum latch speed is reduced. In particular, the speed with which the latch 6 meets the shank 2 of the machine knitting needle 1 in the back position of the latch is reduced. Thus the cause of needle destruction or needle wear that otherwise occurs is greatly reduced. By using the needle of the invention, the knitting speed can be increased and the service life can be prolonged.

The machine knitting needle of the invention, beginning at its hook 3, between the hook 3 and its latch bearing 9, has a convex or at least not concave shank contour, which defines the inner hook contour and on one end 18 adjoins the concave inner hook contour directly. It is attained as a result that the elevation angle which a yarn 23, located in the hook 3, must overcome if it is to slide on the shank does not increase at any point along the inner contour 17. Preferably, it even decreases steadily. It thus has its maximum value inside a space which is defined on the one hand by the inner hook contour 15 and on the other by a plumb line L or L1 which is dropped, from the hook tip 12 or its tapering portion 11, onto the needle back 16, or if the needle back is not oriented parallel to the direction of motion of the machine knitting needle, onto the arrow that defines the direction of motion. The convex or at least not concave shank contour 17 merges continuously variably with the likewise convex contour of the needle cheek 7.

| List of Reference Numerals: | |
|---|---|
| 1 | Machine knitting needle |
| 2 | Shank |
| 3 | Hook |
| 4 | Needle body |
| 5 | Butt |
| 6 | Latch |
| 7 | Needle cheek |
| 8 | Sawslot |
| 9 | Latch bearing |
| 10 | Point |
| 11 | Center of taper |
| 12 | Tip |
| 13, 13' | Center of curvature |
| 14 | Hook interior |
| 15 | Inner hook contour |
| 16 | Needle back |
| 17 | Shank contour |

-continued

| List of Reference Numerals: | |
|---|---|
| 18 | End |
| 19 | Region |
| 20, 21 | Line |
| 22 | Spoon |
| 23, 28 | Yarn |
| 24 | Inner side |
| 25 | Arrow |
| 26, 27 | Center of curvature |
| 31 | Cheek elevation |
| 32 | Throat |
| 33 | Point |
| 34 | End |
| 35 | Point |
| B | Direction of motion |
| R1 | Radius |
| L, L1, L2 | Plumb line |
| H | Shank height |
| $\alpha$ | elevation angle |

The invention claimed is:

1. A machine knitting needle, comprising:

a needle shank, on a free end of which a hook with a concave inner hook contour is embodied, the hook ending in a tip; and a latch, which at a needle cheek region of the shank is pivotably supported by a latch bearing between a closing position and a back position;

wherein the shank has a non-concave shank contour extending from the hook to the needle cheek.

2. The machine knitting needle as defined by claim 1, wherein a substantially frustoconical tapering portion adjoins the tips, and wherein the tip is rounded.

3. The machine knitting needle as defined by claim 1, wherein one end of the shank contour is located inside the hook.

4. The machine knitting needle as defined by claim 1, wherein one end of the shank contour is located outside the hook.

5. The machine knitting needle as defined by claim 1, wherein the spacing between a back of the needle shank to an end of the shank contour proximate to the hook is less than the spacing from the back of the needle shank to a highest point of the needle cheek.

6. The machine knitting needle as defined by claim 2, wherein a transition point from the concave inner hook contour to the shank contour is located at least as far away from the latch bearing as the tapering portion of the tip.

7. The machine knitting needle as defined by claim 1, wherein a radius of curvature of the shank contour is substantially constant.

8. The machine knitting needle as defined by claim 1, wherein the shank contour is convex.

9. The machine knitting needle as defined by claim 1, wherein the latch is embodied as concave on its side facing toward the shank.

10. The machine knitting needle as defined by claim 1, wherein an elevation angle a defined by the non-concave shank contour decreases between the hook and the needle cheek.

11. The machine knitting needle as defined by claim 1, wherein an inner surface of the latch facing the needle shank intersects the non-concave shank contour at a intersection point when the latch is in the closing position, and wherein an elevation angle α defined by the shank contour does not increase between an end of the concave inner hook contour and the intersection point.

12. The machine knitting needle as defined by claim 1, wherein an inner surface of the latch facing the needle shank intersects the non-concave shank contour at an intersection point when the latch is in the closing position, and wherein an elevation angle α of the shank contour decreases between an end of the concave inner hook contour and the intersection point.

* * * * *